US006495465B2

(12) United States Patent
Nakayoshi et al.

(10) Patent No.: US 6,495,465 B2
(45) **Date of Patent: *Dec. 17, 2002**

(54) METHOD FOR APPRAISING THE CONDITION OF A SEMICONDUCTOR POLISHING CLOTH

(75) Inventors: Yuichi Nakayoshi, Miyazaki (JP); Naoki Yamada, Miyazaki (JP)

(73) Assignee: Komatsu Electronic Metals Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/266,051

(22) Filed: Mar. 10, 1999

(65) Prior Publication Data

US 2001/0026948 A1 Oct. 4, 2001

(30) Foreign Application Priority Data

Mar. 10, 1998 (JP) ..... 10-057992

(51) Int. Cl.[7] ..... H01L 21/302
(52) U.S. Cl. ..... 438/691; 438/692; 438/693
(58) Field of Search ..... 438/690, 691, 438/692, 693; 156/636.1, 345; 451/41, 288, 289

(56) References Cited

U.S. PATENT DOCUMENTS 5,514,245 A * 5/1996 Doan et al. ..... 156/636.1
5,571,373 A * 11/1996 Krishna et al. ..... 156/345
5,660,581 A * 8/1997 Shin et al. ..... 451/289
5,860,848 A * 1/1999 Loncki et al. ..... 451/36
5,904,557 A * 5/1999 Komiya et al. ..... 438/633
5,948,205 A * 9/1999 Kodera et al. ..... 156/345
6,014,218 A * 1/2000 Bradl et al. ..... 356/381
6,059,921 A * 5/2000 Kato et al. ..... 156/345

FOREIGN PATENT DOCUMENTS

JP 05-306924 11/1993

* cited by examiner

*Primary Examiner*—Felisa Hiteshew
*Assistant Examiner*—Lan Vinh
(74) *Attorney, Agent, or Firm*—Sheridan Ross P.C.

(57) ABSTRACT

The present invention provides a method for appraising the condition of a polishing cloth, and a method for manufacturing semiconductor wafers employing the disclosed appraisal method, allowing acceptably low light point defect numbers of semiconductor wafers to be maintained. The disclosed method comprises polishing the semiconductor wafer using a polishing cloth, washing the wafer, and drying the wafer. The size of particles comprising light point defects is chosen, and the number of light point defects on the semiconductor wafer is counted. Typically, the diameter of particles comprising light point defects is set as 0.12 $\mu$m or greater. The polishing cloth is exchanged when the number of light point defects counted exceeds a prescribed number.

31 Claims, 2 Drawing Sheets

METHOD FOR APPRAISING THE CONDITION OF A SEMICONDUCTOR POLISHING CLOTH

RELATED APPLICATIONS

This application claims priority under 35 U.S.C. §119 from Japanese Patent Application No. 10-057992, which has a priority date of Mar. 10, 1998. This application is incorporated by reference herein in its entirety.

FIELD OF THE INVENTION

The present invention relates to a method for appraising the condition of a polishing cloth used to polish semiconductor wafers, and a method for making semiconductor wafers using a polishing cloth so appraised. In particular, the invention relates to ensuring the cleanliness of semiconductor wafers produced using a polishing cloth.

BACKGROUND OF THE INVENTION

The quality of a semiconductor wafer that is polished with a polishing cloth is specified by the shape quality and the cleanliness of the surface thereof. The shape quality is evaluated using the micro-roughness measurement, such as the peak-to-valley (P-V) measurement, or by a measurement of uneven thickness (e.g., Total Thickness Variation (TTV) or (LTV)). The cleanliness of the surface is determined by counting the number of particles on the surface. The diameter of particles to be counted becomes smaller year by year due to the increasingly stringent demands of industry, making them increasingly difficult to distinguish from crystal original pits (COP). Therefore, in practice, particles are counted as part of a light point defect (LPD) number, in which particles and COP are counted together. In the LPD measurement technique, the surface of the semiconductor wafer is irradiated with laser light. Where a particle or COP exists, the reflected light from the laser is scattered. The existence of particles or COPs is detected by receivers that measure the scattered light. In the LPD measurement, the particle diameter is preset and the total number of particles and COPs that are the same size or larger than that preset diameter are counted.

However, the measured LPD number is just a measurement result. To obtain better semiconductor wafer quality, factors affecting that quality need to be improved. As a result of the inventor's studies, it has been discovered that the condition of polishing cloths used to polish semiconductor wafers is one such factor. However, the conventional index used to judge the condition of polishing cloths is based only on a measurement of the polished off thickness. Thus, this conventional method evaluates only the rate at which the polishing cloth polishes the semiconductor wafer. Therefore, under conventional methods, the polishing cloth will not be exchanged so long as it continues to polish off a certain thickness of semiconductor material, even if the LPD number increases. This means that a low LPD number cannot be maintained if the polishing rate of the cloth has not deteriorated. Simply counting the number of times that a polishing cloth has been used does not allow for consistently low LPD numbers to be maintained. The subject matter of the present invention is to provide a method for appraising the condition of a polishing cloth, and to provide a method for manufacturing semiconductor wafers employing the appraisal method, to allow low LPD numbers to consistently be maintained.

SUMMARY OF THE INVENTION

The present invention includes a method for appraising the condition of a polishing cloth used to polish semiconductor wafers. The method includes measuring the number of LPDs on the polished surface of the semiconductor wafer after it has been polished using the polishing cloth that is being appraised. In particular, after the wafer has been polished, washed, and dried, the number of LPDs having a certain diameter or greater are counted. The condition of the polishing cloth is appraised by the number of LPDs, this number being a cloth quality index. When the number of LPDs reaches or exceeds a prescribed number, the polishing cloth is exchanged for a fresh one before the next semiconductor wafer is polished. In a preferred embodiment of the present invention, the diameter of particles comprising the LPDs to be counted is greater than about 0.12 $\mu$m. In a most preferred embodiment, the diameter of particles comprising the LPDs to be counted is greater than a certain diameter, and that certain diameter is from about 0.12 $\mu$m to about 0.16 $\mu$m.

The present invention also includes a method for manufacturing semiconductor wafers that are polished using a polishing cloth, while maintaining consistently low LPD numbers. The method includes polishing a semiconductor wafer using a polishing cloth, and determining the number of LPDs having a certain particle size or greater. When the number of LPDs of the specified size or greater meets or exceeds a prescribed number, the polishing cloth is exchanged for a new one. This exchange takes place before the next semiconductor wafer is to be polished. In a preferred embodiment of the invention, the size of particles comprising LPDs is greater than about 0.12 $\mu$m. In a most preferred embodiment, the diameter of particles comprising the LPDs to be counted is greater than a certain diameter, and that certain diameter is from about 0.12 $\mu$m to about 0.16 $\mu$m.

DETAILED DESCRIPTION

The present invention concerns a method for appraising the condition of cloths used to polish the surface of semiconductor wafers. The present invention also concerns a method for manufacturing semiconductor wafers that are polished using a polishing cloth.

The method comprises polishing a semiconductor wafer using a polishing cloth, and then washing and drying the wafer using conventional processes, well-known to those skilled in the art. After the semiconductor wafer has dried, the number of light point defects (LPD) of a specific size or greater are counted. When the number of LPDs counted meets or exceeds a prescribed number, the polishing cloth is exchanged before the next wafer is polished.

In one embodiment of the present method, the particle size or diameter is preferably greater than a certain diameter, and that certain diameter is from about 0.12 $\mu$m to about 0.16 $\mu$m. Such a certain range of particle sizes or diameters is preferable because of the improved measurement precision in such a range, reducing the chance that the condition of the cloth will be misappraised. This in turn prevents the premature exchange of the polishing cloth, or an excessive number of LPDs on the semiconductor wafers.

Figure 1:
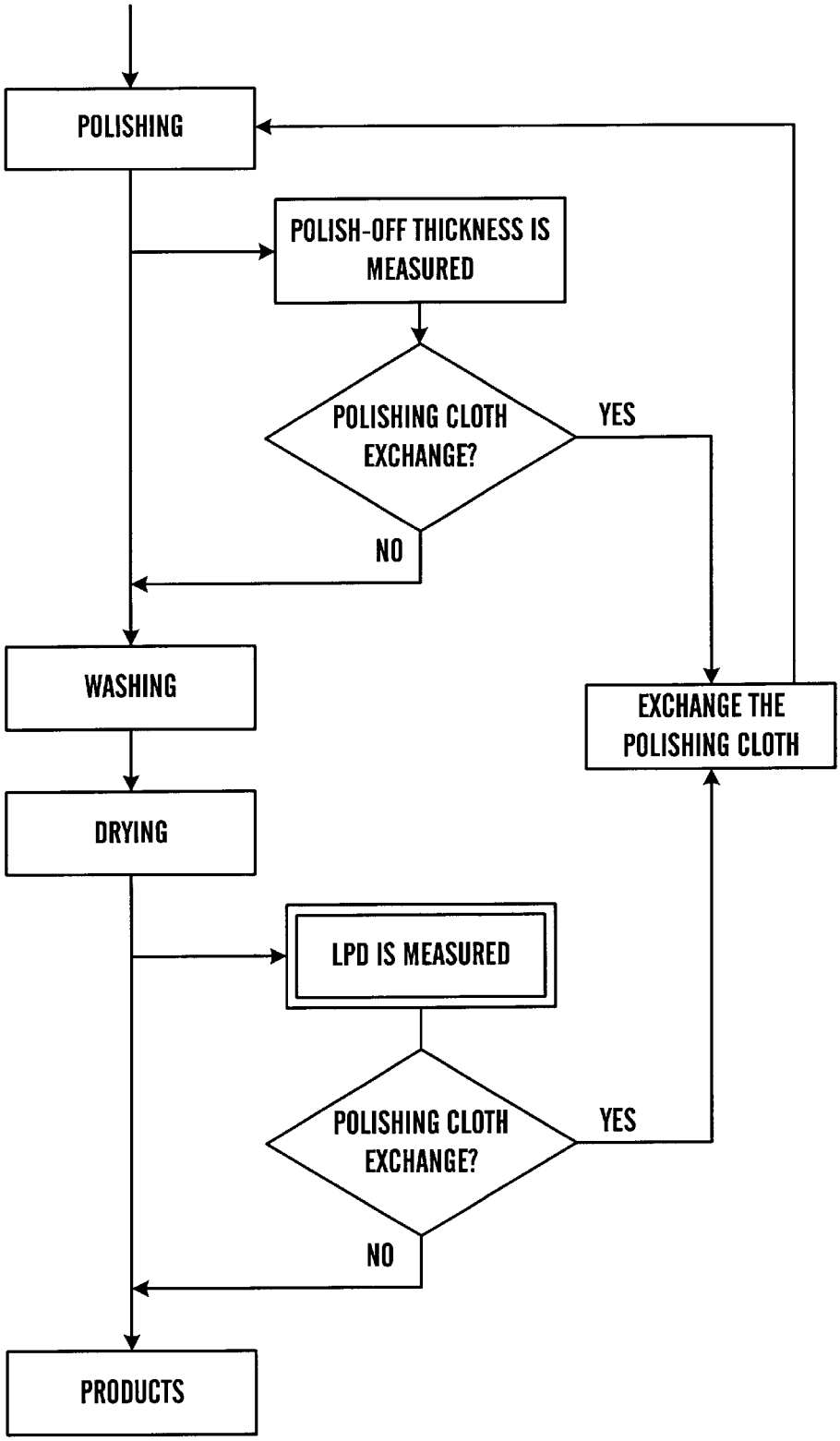
FIG. 1 is a flow chart showing a method for manufacturing a semiconductor wafer according to the present invention.

An additional embodiment of the present method is illustrated in FIG. 1. As shown in FIG. 1, the semiconductor wafer is washed and dried after it has been polished. Separately, after the polishing step, the polishing rate of the polishing cloth is measured. If the polishing rate falls below a prescribed level, the polishing cloth is exchanged before the next wafer is polished. After the semiconductor wafer has dried, the number of LPDs is measured. In one embodiment, the diameter of particles counted as LPDs is 0.12 $\mu$m or greater. According to the present invention, if the number of such LPDs exceeds a prescribed or indexed amount, for example, 4, the polishing cloth is exchanged before the next wafer is polished. When the measured LPD number is less than the prescribed number of defects, and measuring that the polishing rate at a given polishing force is within chosen limits, there is no need to exchange the cloth. Judging from the polishing rate is similar to the prior arts. When the polishing rate is less than prescribed value, the cloth is exchanged before polishing another wafer. The semiconductor wafers used for measuring the LPD may then be re-washed and re-dried if necessary, and then the wafers thereof are doped as products.

Figure 2:
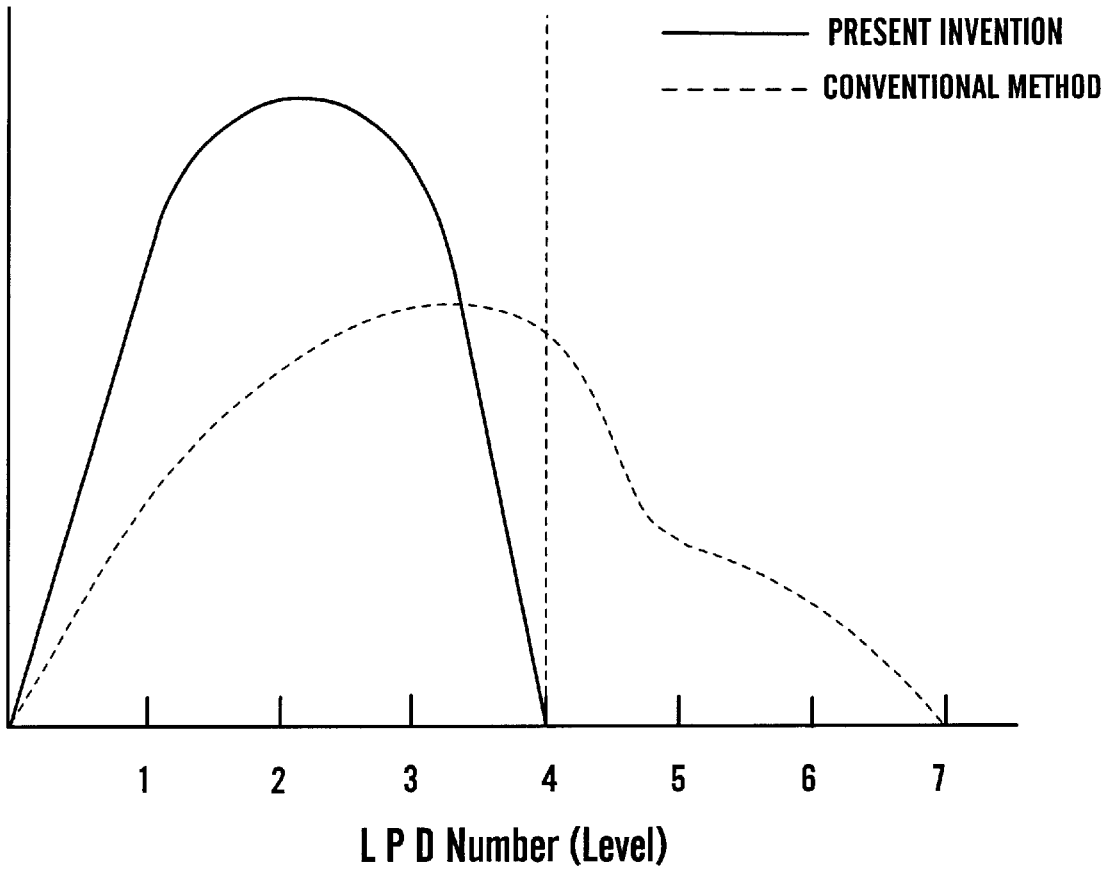
FIG. 2 is a graph plotting the wafer frequency versus the number of light point defects on the wafer, and comparing semiconductor wafers manufactured according to the present invention with semiconductor wafers produced by the conventional method.

As shown in FIG. 2, the LPD number of a semiconductor wafer produced using the prescribed method can be maintained, for example, at a level of 4 or less. By replacing the polishing cloth when the number of LPDs meets or exceeds 4, a consistent supply of semiconductor wafers having a total number of LPDs of 4 or less can be maintained.

In a further embodiment of the present invention, the LPD measurement may be conducted after a temporary wash, immediately following the polishing step. The LPD number obtained by using this method may then be used as a factor for determining whether the polishing cloth should be exchanged or not. Generally, the number of LPDs counted according to this embodiment of the invention will be higher than the number of LPDs counted after a full wash and dry of the semiconductor wafer, but this embodiment leads to earlier recognition of the LPD level, so exchange of the polishing cloth is indicated immediately.

In an additional embodiment, the disclosed method may be used to appraise the quality of a new polishing cloth. Thus, the method may be applied even where the polishing cloth has just been exchanged, to ensure that wafers produced using the cloth are of the desired quality.

The method of the present invention allows the LPDs of semiconductor wafers produced using the method to be maintained at an acceptable level. Furthermore, the present method ensures a reliable supply of high quality wafers.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A method for appraising the condition of a polishing cloth used to polish semiconductor wafers, comprising:

selecting a diameter of particle defining a light point defect;

selecting a number of light point defects;

polishing a semiconductor wafer with said polishing cloth;

counting a number of light point defects on said semiconductor wafer after said step of polishing; and replacing said polishing cloth if said counted number of light point defects is greater than said selected number of light point defects.

2. The method of claim 1, wherein said selected diameter of particle defining a light point defect is greater than about 0.12 $\mu$m.

3. The method of claim 1, wherein said selected diameter of particle defining a light point defect is greater than a certain diameter, and said certain diameter is about 0.12 $\mu$m.

4. The method of claim 1, wherein said selected diameter of particle defining a light point defect is greater than a certain diameter, and said certain diameter is about 0.16 $\mu$m.

5. A method for appraising the condition of a polishing cloth used to polish semiconductor wafers, comprising:

selecting a diameter of particle defining a light point defect;

selecting a number of light point defects;

polishing a semiconductor wafer with said polishing cloth;

washing said semiconductor wafer;

drying said semiconductor wafer;

counting a number of light point defects on said semiconductor wafer after said step of drying; and replacing said polishing cloth if said counted number of light point defects is greater than said selected number of light point defects.

6. The method of claim 5, wherein particles defining light point defects have a diameter greater than about 0.12 $\mu$m.

7. The method of claim 5, wherein particles defining light point defects have a diameter greater than a certain diameter, and said certain diameter is about 0.12 $\mu$m.

8. The method of claim 5, wherein particles defining light point defects have a diameter greater than a certain diameter, and said certain diameter is about 0.16 $\mu$m.

9. A method for manufacturing semiconductor wafers that are polished using a polishing cloth, comprising:

selecting a diameter of particle defining a light point defect;

selecting a number of light point defects;

polishing a semiconductor wafer with a polishing cloth;

washing said semiconductor wafer;

drying said semiconductor wafer;

counting an actual a number of light point defects on said semiconductor wafer after said step of drying; and replacing said polishing cloth if said actual number of light point defects is greater than said selected number of light point defects before polishing a next semiconductor wafer.

10. The method of claim 9, wherein said selected diameter of particle defining a light point defect is greater than about 0.12 $\mu$m.

11. The method of claim 9, wherein said selected diameter of particle defining a light point defect is greater than a certain diameter, and said certain diameter is about 0.16 $\mu$m.

12. The method of claim 9, wherein said selected diameter of particle defining a light point defect is greater than a certain diameter, and said certain diameter is about 0.12 $\mu$m.

13. A method for appraising the condition of a polishing cloth used to polish semiconductor wafers, comprising:

selecting a diameter of particle defining a light point defect;

selecting a number of light point defects;

polishing a semiconductor wafer with said polishing cloth;

counting all light point defects of said selected diameter on said semiconductor wafer after said step of polishing; and replacing said polishing cloth if said counted number of light point defects is greater than said selected number of light point defects.

14. The method of claim 13, wherein said selected diameter of particle defining a light point defect is greater than about 0.12 μm.

15. The method of claim 13, wherein said selected diameter of particle defining a light point defect is greater than about 0.16 μm.

16. A method for appraising the condition of a polishing cloth used to polish semiconductor wafers, comprising:

selecting a diameter of particle defining a light point defect;

selecting a number of light point defects;

polishing a semiconductor wafer with said polishing cloth;

washing said semiconductor wafer;

drying said semiconductor wafer;

counting all light point defects of said selected diameter on said semiconductor wafer after said step of drying; and replacing said polishing cloth if said counted number of light point defects is greater than said selected number of light point defects.

17. The method of claim 16, wherein said selected diameter of a particle defining a light point defect is greater than about 0.12 μm.

18. The method of claim 16, wherein said selected diameter of a particle defining a light point defect is greater than about 0.16 μm.

19. A method for manufacturing semiconductor wafers that are polished using a polishing cloth, comprising:

selecting a diameter of particle defining a light point defect;

selecting a number of light point defects;

polishing a semiconductor wafer with a polishing cloth;

washing said semiconductor wafer;

drying said semiconductor wafer;

counting all light point defects of said selected diameter on said semiconductor wafer after said step of drying; and replacing said polishing cloth if said counted number of light point defects is greater than said selected number of light point defects before polishing a next semiconductor wafer.

20. The method of claim 19, wherein said selected diameter of a particle defining a light point defect is greater than about 0.12 μm.

21. The method of claim 19, wherein said selected diameter of a particle defining a light point defect is greater than about 0.16 μm.

22. A method for appraising the condition of a polishing cloth used to polish semiconductor wafers so as to achieve fewer than a first number of light point defects of at least a first diameter on said wafers, comprising:

polishing a semiconductor wafer with said polishing cloth;

counting all light point defects of at least said first diameter on said semiconductor wafer after said step of polishing; and replacing said polishing cloth if said counted number of light point defects is greater than said first number of light point defects.

23. The method of claim 22, wherein said first diameter is greater than about 0.12 μm.

24. The method of claim 22, wherein said first diameter is greater than about 0.16 μm.

25. A method for appraising the condition of a polishing cloth used to polish semiconductor wafers so as to achieve fewer than a first number of light point defects of at least a first diameter on said wafers, comprising:

polishing a semiconductor wafer with said polishing cloth;

washing said semiconductor wafer;

drying said semiconductor wafer;

counting all light point defects of at least said first diameter on said semiconductor wafer after said step of drying; and replacing said polishing cloth if said counted number of light point defects is greater than said first number of light point defects.

26. The method of claim 25, wherein said first diameter is greater than about 0.12 μm.

27. The method of claim 25, wherein said first diameter is greater than about 0.16 μm.

28. A method for manufacturing semiconductor wafers that are polished using a polishing cloth so as to achieve fewer than a first number of light point defects of at least a first diameter on said wafers, comprising:

polishing a semiconductor wafer with a polishing cloth;

washing said semiconductor wafer;

drying said semiconductor wafer;

counting all light point defects of at least said first diameter on said semiconductor wafer after said step of drying; and replacing said polishing cloth if said counted number of light point defects is greater than said first number of light point defects before polishing a next semiconductor wafer.

29. The method of claim 28, wherein said first diameter is greater than about 0.12 μm.

30. The method of claim 28, wherein said first diameter is greater than about 0.16 μm.

31. A method for polishing semiconductor wafers, comprising:

a) specifying a minimum light point defect diameter;

b) specifying a maximum acceptable number of light point defects having a diameter at least as large as said minimum light point defect diameter;

c) after completing steps a and b, polishing a semiconductor wafer with a polishing cloth;

d) after completing step c, counting a number of light point defects on said semiconductor wafer having a diameter at least as large as said specified diameter to obtain a counted number of light point defects; and e) replacing said polishing cloth in response to a counted number of light point defects that is greater than said specified maximum acceptable number of light point defects having a diameter at least as large as said specified diameter.

* * * * *